US007715773B2

(12) United States Patent
Ide et al.

(10) Patent No.: US 7,715,773 B2
(45) Date of Patent: May 11, 2010

(54) CLEANING DEVICE, FIXING DEVICE, AND IMAGE FORMING APPARATUS

(75) Inventors: Atsushi Ide, Nara (JP); Toyoaki Nanba, Higashiosaka (JP); Takashi Kubo, Kyoto (JP)

(73) Assignee: Sharp Kabushiki Kaisha, Osaka (JP)

( * ) Notice: Subject to any disclaimer, the term of this patent is extended or adjusted under 35 U.S.C. 154(b) by 541 days.

(21) Appl. No.: 11/679,200

(22) Filed: Feb. 27, 2007

(65) Prior Publication Data

US 2007/0258739 A1 Nov. 8, 2007

(30) Foreign Application Priority Data

Mar. 6, 2006 (JP) ..... 2006-058903

(51) Int. Cl.
*G03G 15/20* (2006.01)

(52) U.S. Cl. ..... 399/327

(58) Field of Classification Search ..... 399/107, 399/122, 123, 320, 327, 343, 352; 15/256.5; 400/703, 708

See application file for complete search history.

(56) References Cited

U.S. PATENT DOCUMENTS 5,168,314 A * 12/1992 Gunji et al. ..... 399/327
5,559,591 A * 9/1996 Kato et al. ..... 399/327
5,850,588 A * 12/1998 Yoshikawa ..... 399/327
6,539,195 B2 * 3/2003 Sakaba et al. ..... 399/326
6,665,513 B2 * 12/2003 Katoh ..... 399/327
7,483,662 B2 * 1/2009 Shinkawa et al. ..... 399/326

FOREIGN PATENT DOCUMENTS

| | | |
|---|---|---|
| JP | 04-316058 | 11/1992 |
| JP | 06-135096 | 5/1994 |
| JP | 07-261591 | 10/1995 |
| JP | 7-311517 | 11/1995 |
| JP | 08-095438 | 4/1996 |
| JP | 2003-107952 | 4/2003 |

* cited by examiner

*Primary Examiner*—Hoan Tran
(74) *Attorney, Agent, or Firm*—Renner, Otto, Boisselle & Sklar, LLP

(57) ABSTRACT

A cleaning device according to the present invention comprises which includes a cleaning belt, an unwinder, a winder, and a detector. The unwinder is wound with the cleaning belt. The winder winds up the cleaning belt intermittently from the unwinder along a path leading past a cleaning position where the belt is brought into contact with a body to be cleaned. The detector is fitted in a detecting position on the path between the unwinder and the cleaning position. The cleaning belt has an end point set on it near its trailing end and associated with the detecting position. When detecting the end point, the detector outputs a detection signal.

8 Claims, 6 Drawing Sheets

CLEANING DEVICE, FIXING DEVICE, AND IMAGE FORMING APPARATUS

CROSS REFERENCE

This Nonprovisional application claims priority under 35 U.S.C. §119(a) on Patent Application No. 2006-058903 filed in Japan on Mar. 6, 2006, the entire contents of which are hereby incorporated by reference.

BACKGROUND OF THE INVENTION

The present invention relates to a cleaning device for cleaning a surface of a body by intermittently feeding a cleaning belt in compressive contact with the surface. The invention also relates to a fixing device including a fixing roller as a body to be cleaned. The invention further relates to an image forming apparatus including such a fixing device.

An image forming apparatus for electrophotographic image formation includes a fixing device with a pair of fixing rollers. One of the fixing rollers is a heating roller heated to a temperature at which toner can melt. The other fixing roller is a pressing roller in compressive contact with the heating roller. While a recording medium such as paper having a toner image transferred to it is passing between the fixing rollers, the fixing device heats and presses the medium so as to fix the image on the medium.

While the recording medium is passing between the fixing rollers, part of the toner transferred to the medium sticks to the cylindrical surfaces of the rollers. The toner on the roller surfaces would dirty or spoil the following recording media passing between the fixing rollers. Therefore, the fixing device is fitted with cleaning devices for removing the toner on the roller surfaces.

In recent years, it has been demanded that image forming apparatus perform image formation at higher speed and accordingly feed recording media at higher speed. When recording media pass at higher speed between the fixing rollers of an image forming apparatus, larger amounts of toner stick to the cylindrical surfaces of the rollers. The cleaning devices fitted to the fixing device of the apparatus need to remove large amounts of toner on the roller surfaces reliably over a long time.

As disclosed in JP-2003-107952A, a conventional cleaning device includes a cleaning belt called a web sheet, which may be made of woven cloth. The cleaning belt is wound on an unwinder and can be fed intermittently from it via a cleaning position, where the belt is brought into compressive contact with the cylindrical surface of a fixing roller. The fed belt is then wound up by a winder. The cleaning belt is impregnated with a cleaning agent such as silicon oil.

Such a cleaning device can also be applied as a device for cleaning a dirty surface of a part of a device other than the fixing device of image forming apparatus.

As the cleaning belt is wound up repeatedly, its portion remaining on the unwinder decreases, so that a trailing end portion of it becomes unable to be held reliably by the unwinder. The unwinder may include a delivery roller, the cylindrical surface of which is wound with the cleaning belt. If the portion of the cleaning belt that remains on the delivery roller becomes shorter than the circumference of the roller, no sufficient tension can be applied to the belt, so that the belt cannot come into compressive contact with the fixing roller in the cleaning position. This results in insufficient cleaning. If the belt portion on the delivery roller becomes shorter than the roller circumference, a trailing end portion of the cleaning belt becomes loose. The loose belt portion may come into contact with other parts of the apparatus than the fixing roller, so that the parts may be dirtied with the cleaning agent with which the cleaning belt is impregnated, and/or their functions may lower.

Another conventional cleaning device counts the rotations of the delivery roller of an unwinder or the wind-up roller of a winder. Based on the number of rotations of the roller, the cleaning device determines the length of the portion of a cleaning belt that is wound on the roller. Before a trailing end portion of the cleaning belt becomes unable to be held reliably on the unwinder, the user is prompted to replace the belt.

However, the relation between the number of rotations of the delivery or wind-up roller and the length of the belt portion wound on the roller varies with the number of turns of the wound belt portion. Besides, because the cleaning belt is flexible, the relation between the number of rotations and the length of the wound belt portion is not always equal even if the number of turns is equal. In particular, because the wind-up roller is wound with a portion of the cleaning belt to which toner has stuck, it is impossible to accurately determine the relation between the number of rotations of this roller and the length of the belt portion wound on the roller.

Accordingly, it is impossible to accurately detect the length of the wound portion of the cleaning belt of a conventional cleaning device. This prevents the user from being prompted to replace the cleaning belt at the proper time. If the belt replacement is delayed, the body to be cleaned cannot be cleaned sufficiently, and the cleaning agent may dirty other bodies and lower their functions. If the belt replacement is too early, the cleaning belt is thrown away with a long portion of it remaining unused. This results in a high running cost.

SUMMARY OF THE INVENTION

The object of the present invention is to provide a cleaning device, a fixing device, and an image forming apparatus each of which detects between the unwinder and the cleaning position an end point on the cleaning belt that is near to the trailing end of the belt in order to prompt the user to replace the belt at a proper time before the belt end becomes unable to be held reliably on the unwinder, so that the belt on the unwinder can be used without a too long or too short end portion of it remaining unused.

The present invention comprises a cleaning belt, an unwinder, a winder, and a detector. The unwinder is wound with the cleaning belt. The winder winds up the cleaning belt intermittently from the unwinder along a path leading past a cleaning position where the belt is brought into contact with a body to be cleaned. The detector is fitted in a detecting position on the path between the unwinder and the cleaning position. The cleaning belt has an end point set on it near its trailing end and associated with the detecting position. When detecting the end point, the detector outputs a detection signal.

DETAILED DESCRIPTION OF THE INVENTION

Preferred embodiments of the present invention will be described below in detail with reference to the drawings.

Figure 1:
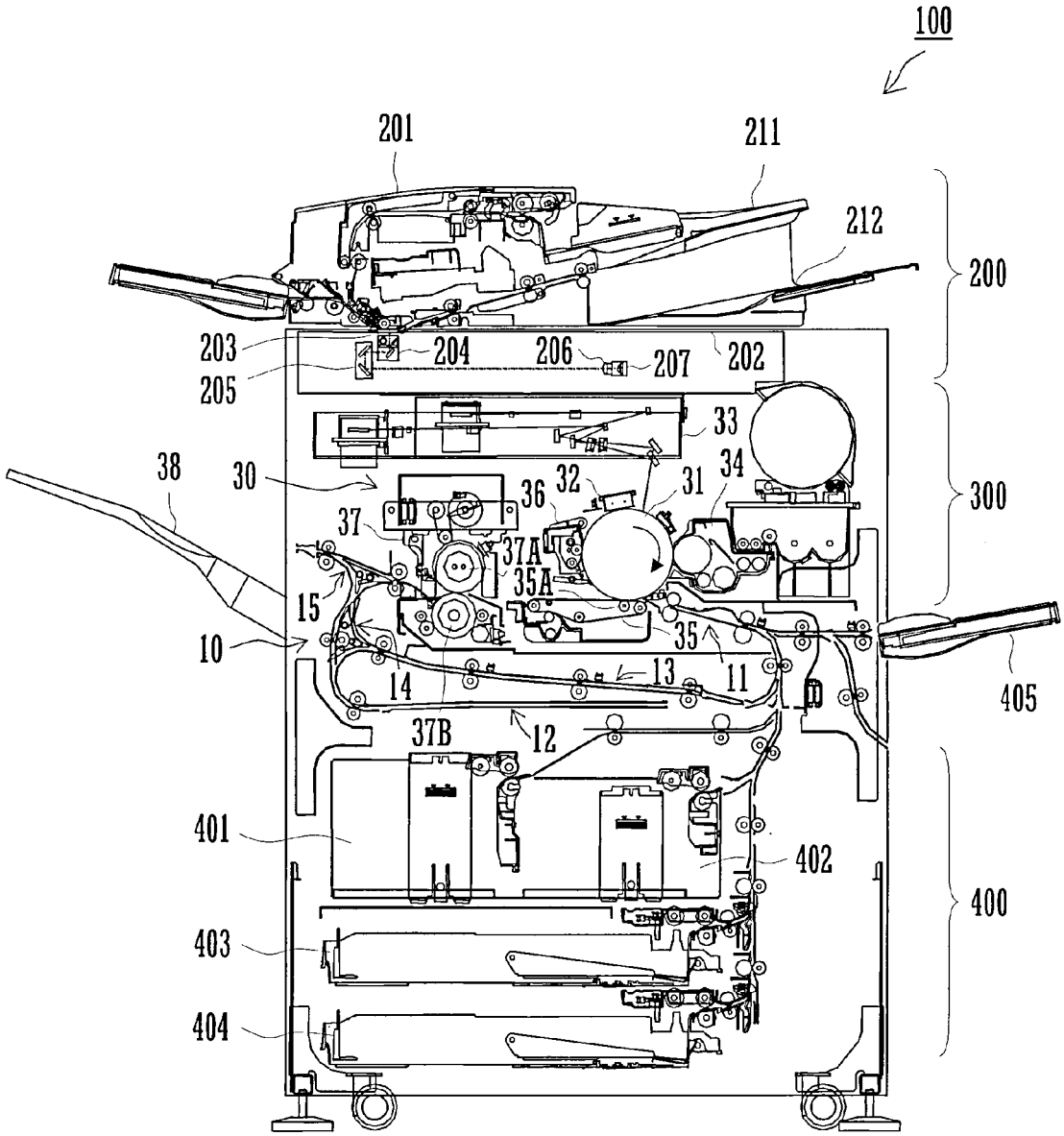
FIG. 1 is a schematic sectional side view of an image forming apparatus according to a first embodiment of the present invention.

FIG. 1 is a schematic sectional side view of an image forming apparatus 100 according to a first embodiment of the present invention. The image forming apparatus 100 includes an image reading unit 200, an image forming unit 300, and a paper feeding unit 400.

The image reading unit 200 includes an ADF (automatic document feeder) 201, a first document platform 202, a second document platform 203, a first mirror base 204, a second mirror base 205, a lens 206, and a CCD (charge coupled device) 207. The CCD 207 might be replaced by another image sensor.

The ADF 201 feeds documents one after one from a document tray 211 via the second document platform 203 to a discharge tray 212. The rear edge of the ADF 201 is supported pivotably in such a manner that the ADF can cover the top of the first document platform 202. By raising the front edge of the ADF 201 so as to expose the first document platform 202, it is possible to place a document manually on this platform.

The document platforms 202 and 203 are a hard glass plate.

The mirror bases 204 and 205 are supported horizontally movably under the document platforms 202 and 203. The speed at which the second mirror base 205 moves is ½ of the speed at which the first mirror base 204 moves. The first mirror base 204 carries a light source and a first mirror. The second mirror base 205 carries a second mirror and a third mirror.

The image on a document being fed by the ADF 201 can be read with the first mirror base 204 stopping under the second document platform 203. The light source on the first mirror base 204 under the second document platform 203 radiates light to the front side of the document passing over this platform. The light reflected by this side of the document is then reflected by the first mirror on the first mirror base 204 toward the second mirror base 205.

The image on a document placed on the first document platform 202 can be read with the mirror bases 204 and 205 moving horizontally under this platform. The light source on the first mirror base 204 moving under the first document platform 202 radiates light to the front side of the document on this platform. The light reflected by this side of the document is then reflected by the first mirror on the first mirror base 204 toward the second mirror base 205.

Whether the ADF 201 is used or not, the light reflected by the front side of the document is incident on the CCD 207 via the second and third mirrors on the second mirror base 205 and the lens 206, with the optical path length constant.

The CCD 207 outputs an electric signal in proportion to the quantity of light reflected by the front side of the document. The electric signal is input as image data into the image forming unit 300.

The image forming unit 300 includes a photosensitive drum 31, a charging device 32, an exposure device 33, a developing device 34, a transfer belt 35, a cleaner 36, and a fixing device 37, which form parts of an image former 30.

The photosensitive drum 31 has a photosensitive layer formed on its cylindrical surface and rotates clockwise in FIG. 1. The charging device 32 charges the drum surface uniformly to a preset electric potential. The charging device 32 may be either a non-contact type charging device with a charger or a contact type charging device with a roller or a brush.

The exposure device 33 irradiates the cylindrical surface of the photosensitive drum 31 with light based on image data. Photoconduction in the photosensitive layer of the drum 31 forms an electrostatic latent image on the irradiated surface of the drum 31. The exposure device 33 scans the drum surface axially of the drum 31 with a laser beam modulated with image data. Alternatively, the exposure device 33 might be replaced by an exposure device having an array of ELs, LEDs, or other light emitting devices.

The developing device 34 supplies the cylindrical surface of the photosensitive drum 31 with toner to make the electrostatic latent image visible.

The transfer belt 35 forms a loop around rollers under the photosensitive drum 31 and has a resistance between about $1\times10^{9}$ and $1\times10^{13}$ Ω·cm. A transfer roller 35A is supported inside the transfer belt 35 and keeps it in compressive contact with the cylindrical surface of the photosensitive drum 31. A transfer voltage is applied to the transfer roller 35A. The toner image on the photosensitive drum 31 is transferred to a sheet of paper passing between the drum and the transfer belt 35.

The cleaner 36 removes the toner remaining on the portion of the drum surface from which the toner image has been transferred.

The fixing device 37 includes a heating roller 37A and a pressing roller 37B. The heating roller 37A has a heater fitted in it for heating it to a temperature at which the toner on this roller can melt. The pressing roller 37B is biased for compressive contact with the heating roller 37A at a preset pressure. While a sheet of paper having a toner image transferred to it is passing between the rollers 37A and 37B, the fixing device 37 heats and presses the sheet so as to fix the image fast on the sheet. After passing through the fixing device 37, the sheet of paper is discharged to a delivery tray 38, which is fitted on one side of the image forming apparatus 100.

The paper feeding unit 400 includes paper feeding cassettes 401-404 and a manual feed tray 405. Each of the paper feeding cassettes 401-404 holds sheets of paper of a size. The manual feed tray 405 supports a sheet of paper of size or quality for less frequent use.

The paper feeding unit 400 feeds sheets of paper one after one from one of the paper feeding cassettes 401-404 or the manual feed tray 405. A sheet of paper fed from the paper feeding unit 400 is conveyed through a paper conveying passage 10 to the image former 30. The paper conveying passage 10 includes a first conveying passage 11, a second conveying passage 12, a third conveying passage 13, a fourth conveying passage 14, and a fifth conveying passage 15.

Figure 2:
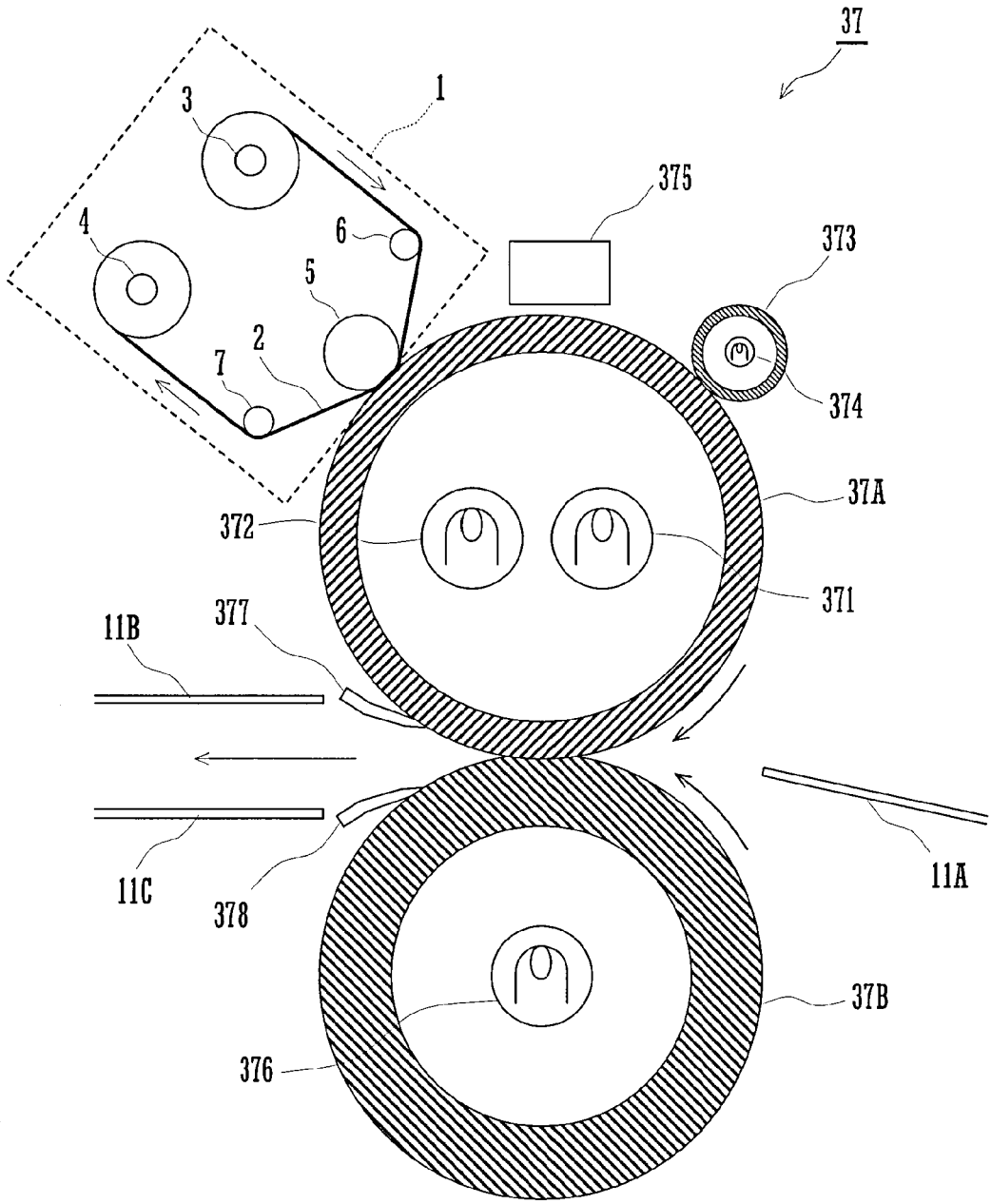
FIG. 2 is a sectional view of the fixing device of the image forming apparatus.

FIG. 2 shows the structure of the fixing device 37. The fixing device 37 includes a pair of fixing rollers, which are the heating roller 37A and the pressing roller 37B, heater lamps 371, 372, 374, and 376, an external heating roller 373, a thermister 375, a cleaning device 1, and release nails 377 and 378.

A sheet of paper conveyed along conveying guides 11A-11C through the first conveying passage 11 has a toner image transferred to its front side. The conveyed sheet passes with its front side up between the heating roller 37A and the pressing roller 37B.

The heater lamps 371 and 372 are fitted in the heating roller 37A. The heater lamp 374 is fitted in the external heating roller 373. The cylindrical surfaces of the heating rollers 37A and 373 are kept in compressive contact with each other. The heater lamps 371 and 372 and the external heating roller 373 heat the heating roller 37A to a preset temperature of about 180-200 degrees C., at which the toner can melt. The thermister 375 senses the surface temperature of the heating roller 37A.

The heater lamp 376 is fitted in the pressing roller 37B and heats it to a temperature of about 150 degrees C. The pressing roller 37B is biased toward the heating roller 37A so that the cylindrical surfaces of these rollers can come into compressive contact with each other.

After the sheet of paper passes between the heating roller 37A and the pressing roller 37B, one of the release nails 377 and 378 releases the sheet from the cylindrical surface of the adjacent roller 37A or 37B if the sheet follows the surface.

While passing between the heating roller 37A and the pressing roller 37B, the sheet of paper is heated and pressed, so that the toner image transferred to it penetrates into it under pressure while melting with heat. After the sheet of paper passes between these rollers 37A and 37B, its temperature lowers, so that the toner image on the sheet hardens and is fixed fast on it.

While the sheet of paper is passing between the heating roller 37A and the pressing roller 37B, part of the toner that has not been fixed, paper dust, etc. on the sheet stick to the cylindrical surface of the heating roller 37A.

The cleaning device 1 includes a web sheet 2 as a cleaning belt, a delivery roller 3, a wind-up roller 4, a pressure roller 5, tension rollers 6 and 7, and a detector 20. The web sheet 2 is a belt of woven or unwoven cloth. The delivery roller 3 and the wind-up roller 4 are supported in an unwinder and a winder respectively. The web sheet 2 moves along the sheet path leading from the unwinder past the tension roller 6, the pressure roller 5, and the tension roller 7 in order to the winder.

The cylindrical surface of the delivery roller 3 is wound with a preset number of turns of the web sheet 2, which has not been used. The wind-up roller 4 winds up a used portion of the web sheet 2 on its cylindrical surface. The pressure roller 5 presses the web sheet 2 against the cylindrical surface of the heating roller 37A in a cleaning position P. The tension rollers 6 and 7 apply a preset tension to the web sheet 2 moving along the sheet path.

The web sheet 2 is kept in compressive contact with the cylindrical surface of the heating roller 37A over a nip width N at the cleaning position P. Every time a preset number of sheets of paper have passed between the heating roller 37A and the pressing roller 37B, the wind-up roller 4 turns by a preset angle, winding up a preset length of the web sheet 2. While the web sheet 2 is sliding on the cylindrical surface of the heating roller 37A, the sheet removes toner, paper dust, etc. from the surface.

While the wind-up roller 4 is rotating to wind up the web sheet 2, the delivery roller 3 rotates. The portion of the web sheet 2 that is wound on the wind-up roller 4 is equal in length to the portion of this sheet that is unwound from the delivery roller 3.

The trailing end of the web sheet 2 is not fixed to the cylindrical surface of the delivery roller 3. When the number of turns of the web sheet 2 on the delivery roller 3 is more than one, the trailing end of this sheet is held fixedly between the sheet and the cylindrical surface of this roller. This results in sufficient tension acting on the web sheet 2 over the sheet path, which leads from the delivery roller 3 past the cleaning position P to the wind-up roller 4.

When the number of turns of the web sheet 2 on the delivery roller 3 is less than one, the trailing end of this sheet is not held between the sheet and the cylindrical surface of this roller but can move freely. This results in no sufficient tension acting on the web sheet 2. In addition, this may bring a trailing end portion of the web sheet 2 into contact with the heating roller 37A and other parts in the fixing device 37. The contact of the web sheet 2 may cause malfunction of the apparatus. The web sheet 2 is impregnated with silicon oil or another cleaning agent, which improves its cleaning function. The cleaning agent dirties the parts in contact with the web sheet 2.

Therefore, it is necessary to detect whether the number of turns of the web sheet 2 on the delivery roller 3 is small or not when the number is more than one. If the number is small, the web sheet 2 needs to be replaced.

Figure 3:
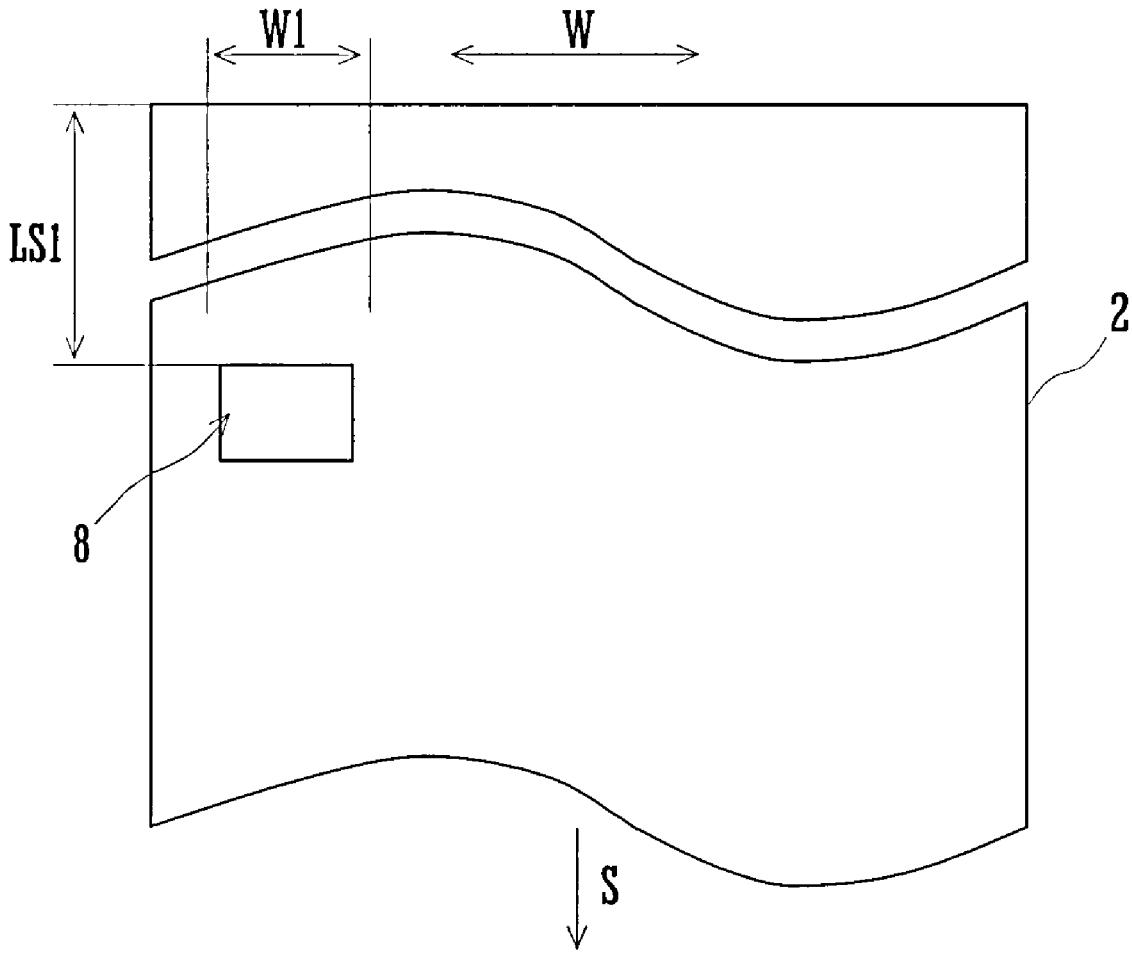
FIG. 3 is a plan view of a trailing end portion of a web sheet used for the cleaning device of the image forming apparatus.

FIG. 3 is a plan view of a trailing end portion of the web sheet 2. The sheet end portion has an opening 8 as the detection part of the present invention. The opening 8 is formed in a zone extending longitudinally of the web sheet 2 and near one edge of it. The zone has a width W1 in the lateral directions W across the web sheet 2. The trailing edge of the opening 8, which is upstream in the wind-up direction S, is spaced a distance LS1 from the trailing end of the web sheet 2.

Figure 4:
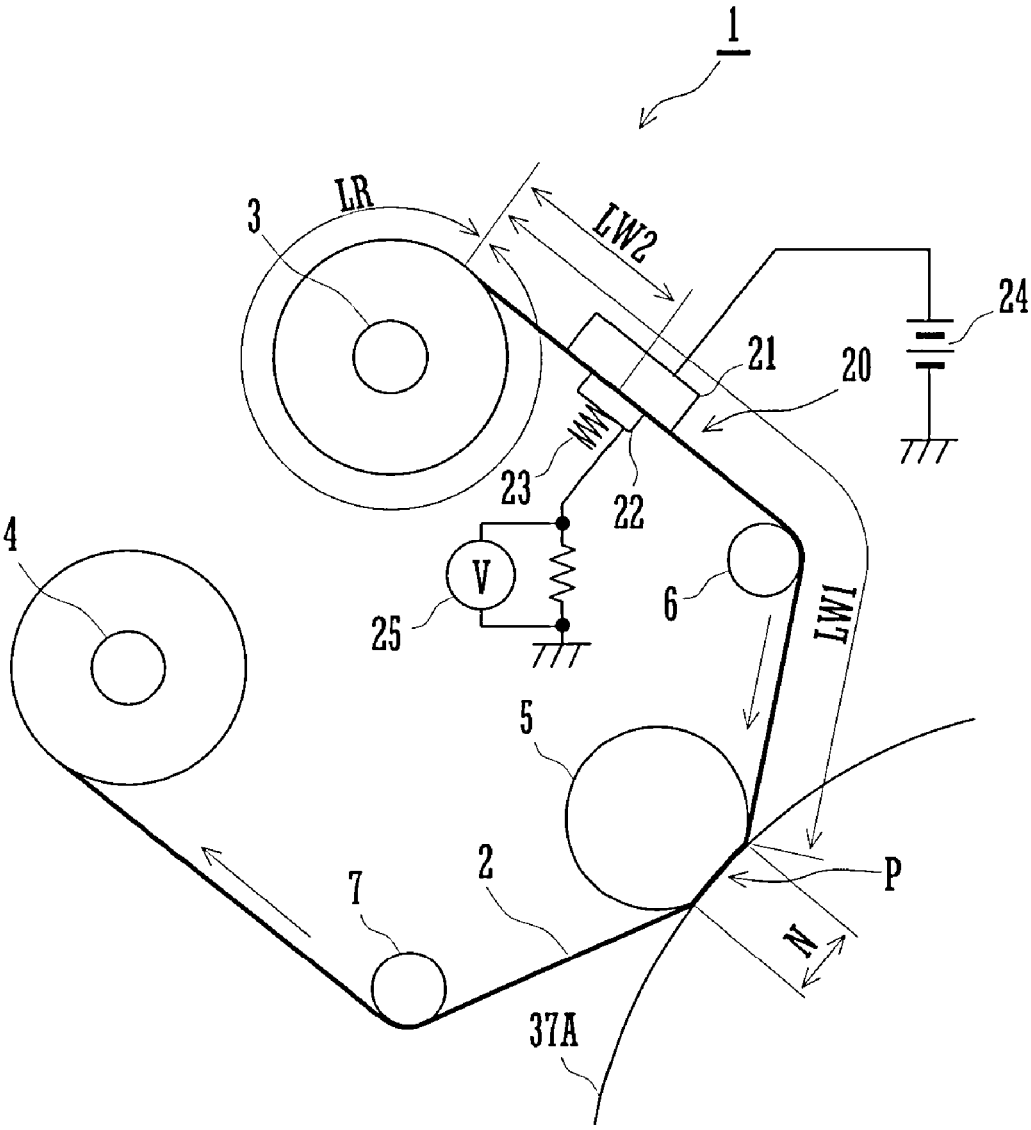
FIG. 4 shows the structure of the cleaning device in detail.

FIG. 4 shows the structure of the cleaning device 1 in detail. As stated already, the cleaning device 1 includes a detector 20, which is fitted on the sheet path between the delivery roller 3 and the tension roller 6. The detector 20 detects the opening 8 in the web sheet 2 and outputs a detection signal.

The detector 20 includes a pair of terminals 21 and 22, a presser 23, a power source 24, and a voltmeter 25. The terminals 21 and 22 are connected to the power source 24 and the voltmeter 25 respectively and positioned on both sides of the web sheet 2. The elasticity of the presser 23 biases the terminal 22 toward the terminal 21 to keep the two terminals in compressive contact with the web sheet 2. The terminals 21 and 22 are positioned in the zone of width W1 of the web sheet 2.

The presser 23 may be a coil spring, which biases the terminal 22 toward the terminal 21. The power source 24 applies a preset voltage to the terminal 21. The voltmeter 25 measures the voltage applied to the terminal 22.

When the opening 8 in the web sheet 2 is not positioned between the terminals 21 and 22, the sheet insulates the terminals, so that the voltmeter 25 detects no voltage. When the opening 8 is positioned between the terminals 21 and 22, they are connected electrically, so that the voltmeter 25 detects the voltage applied to the terminal 22. When the voltmeter 25 detects a voltage equal to or higher than a reference value, it outputs a detection signal. Thus, the detector 20 detects the opening 8 by means of the voltmeter 25.

The detector 20 is positioned at a distance LW2 from the position where the web sheet 2 leaves the cylindrical surface of the delivery roller 3. The distance LS1 (FIG. 3) between the trailing end of the web sheet 2 and the trailing edge of the opening 8 is longer than the sum of the distance LW2 and the circumferential length LR of the delivery roller 3.

When the detector 20 detects the opening 8, at least one turn of the web sheet 2 remains on the delivery roller 3. Accordingly, with sufficient tension acting on the web sheet 2, it is possible to detect that a short portion of the sheet remains on the delivery roller 3.

Figure 5:
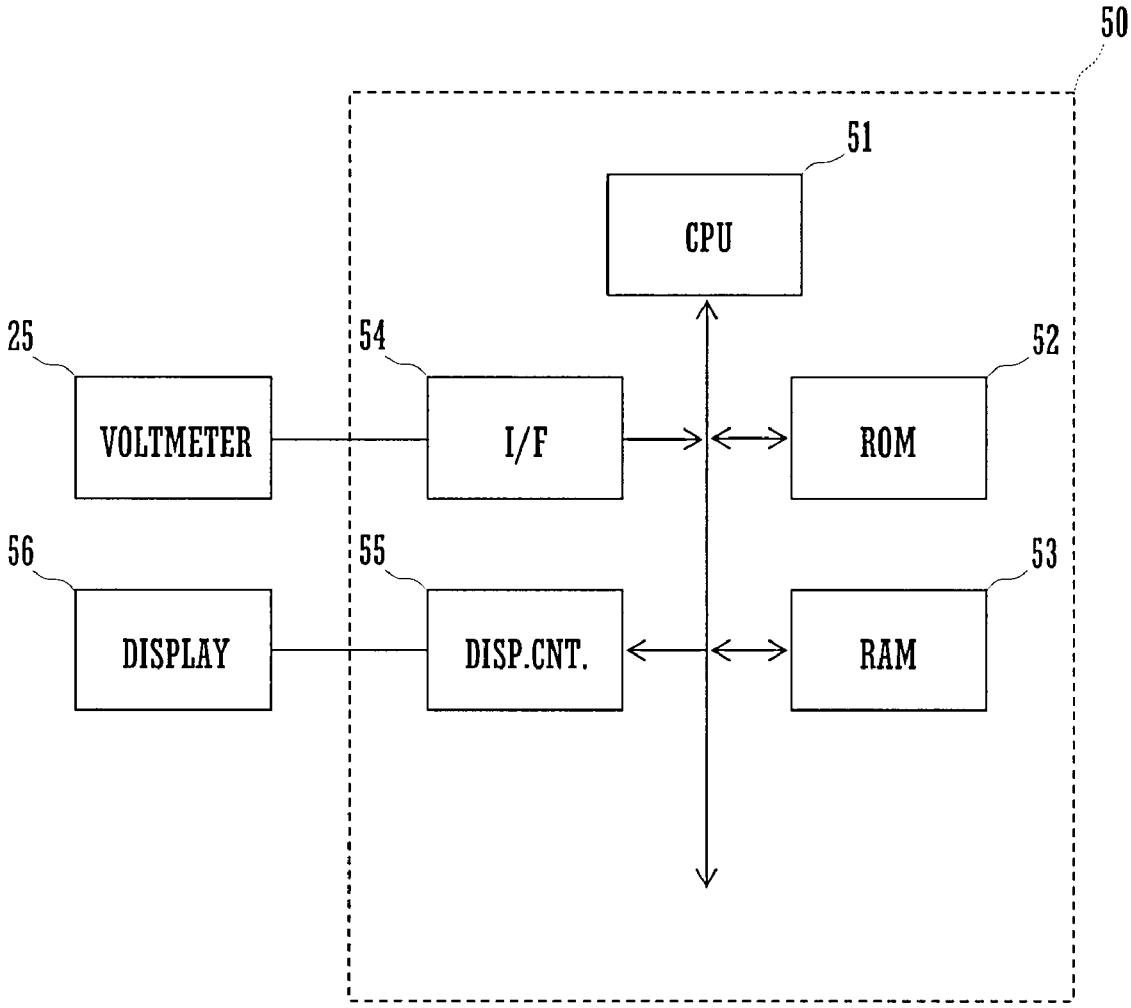
FIG. 5 is a block diagram of the control unit of the image forming apparatus.

FIG. 5 shows the control unit 50 of the image forming apparatus 100, which is the controller of the present invention. The control unit 50 includes a CPU 51, a ROM 52, a RAM 53, and a display controller 54. The detection signal from the voltmeter 25 is input via an interface 54 to the CPU 51. The display controller 55 is connected to a display 56, which is fitted on an outer surface of the image forming apparatus 100.

In accordance with the program written in the ROM 52, the CPU 51 can output the display data for a message prompting the user to replace the web sheet 2. When a detection signal is input to the CPU 51, the CPU outputs the display data to the display controller 55. Based on the display data, the display controller 55 displays the prompting message on the display 56.

The prompting message might be replaced by the number of sheets on which images can be formed by the time the web sheet 2 is replaced. This number is the number of sheets that pass through the fixing device 37 by the time the cylindrical surface of the heating roller 37A is in such a dirty limit condition that the surface can be cleaned by the unused portion of the web sheet 2. This number may be a preset value or a value calculated from the average image concentration in the image formation performed by the image forming apparatus 100.

Thus, while sufficient tension is acting on the web sheet 2, with at least one turn of the sheet remaining on the delivery roller 3, it is possible to prompt the user to replace the sheet. Before the web sheet 2 is replaced, a trailing end portion of it does not move freely. This keeps the apparatus from being dirtied and prevents its malfunction.

Because the opening 8 in the web sheet 2 is detected between the delivery roller 3 and the cleaning position P in the sheet path, the opening is prevented from reaching this position before the sheet is replaced. Accordingly, the cylindrical surface of the heating roller 37A is cleaned reliably until the web sheet 2 is replaced.

Figure 6A:
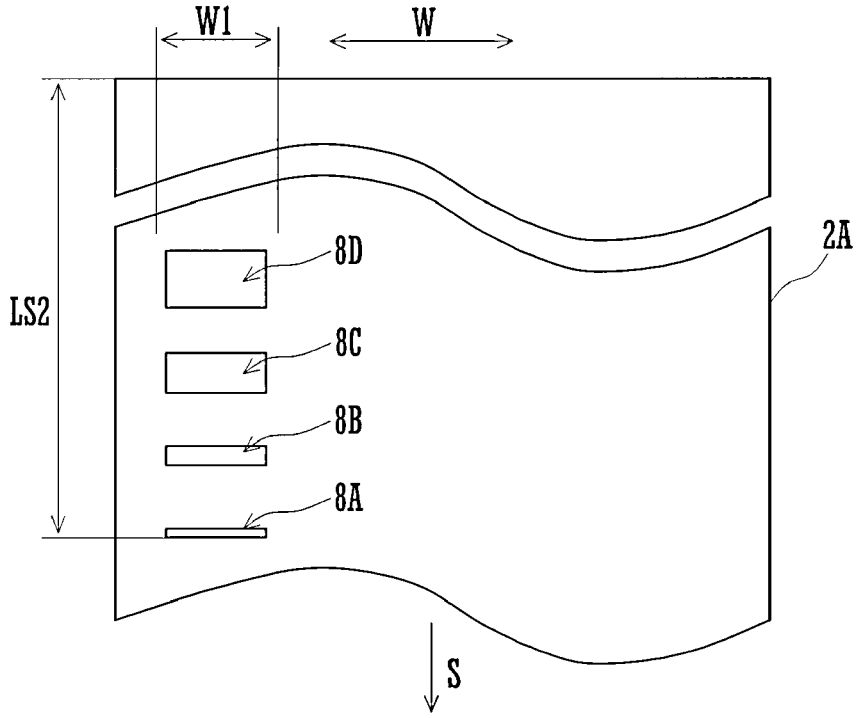
FIG. 6A is a plan view of a trailing end portion of a web sheet used for a cleaning device according to a second embodiment of the present invention.
Figure 6B:
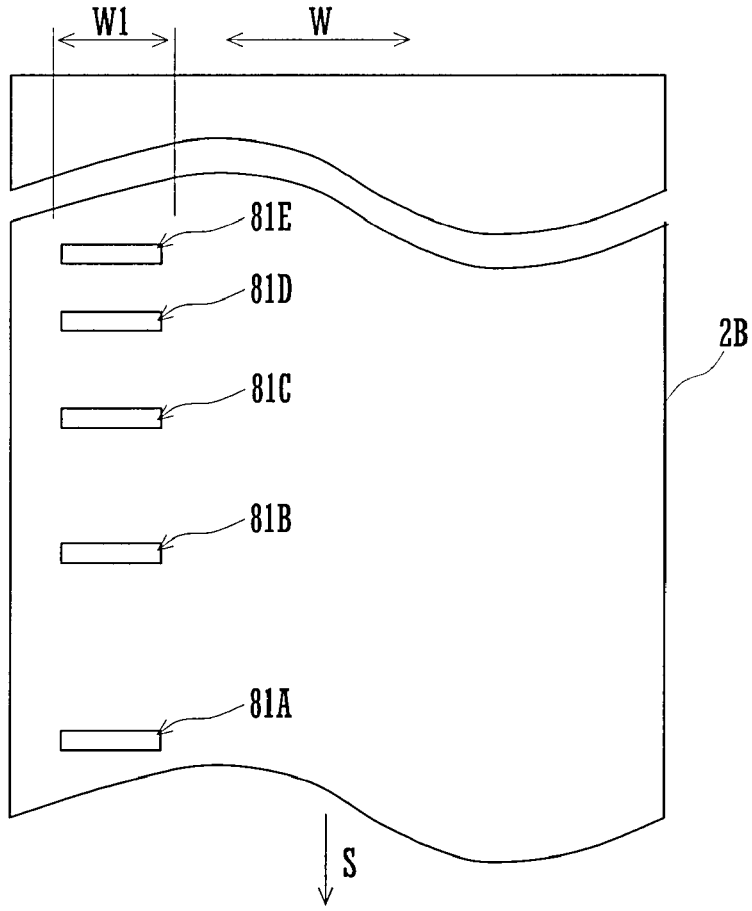
FIG. 6B is a plan view of a trailing end portion of a web sheet used for a cleaning device according to a third embodiment of the present invention.

FIGS. 6A and 6B are plan views of trailing end portions of web sheets 2A and 2B used for cleaning devices according to a second embodiment and a third embodiment respectively of the present invention.

With reference to FIG. 6A, the web sheet 2A has openings 8A-8D formed as detection parts in a zone extending in the wind-up direction S and having the width W1. The openings 8A-8D are spaced in the wind-up direction S. The dimensions of the openings 8A-8D in the wind-up direction S are larger toward the trailing end of the web sheet 2A. Accordingly, the time taken by the detector 20 to detect each of the openings 8A-8D is longer toward the trailing end of the web sheet 2A.

From the differences between the times during which detection signals are input from the voltmeter 25 to the CPU 51, the CPU can determine which of the openings 8A-8D is being detected by the detector 20. It depends on the length of the unused portion of the web sheet 2A which of the openings 8A-8D is being detected by the detector 20. The CPU 51 displays different messages on the display 56 depending on which of the openings 8A-8D is being detected by the detector 20. The messages for the openings 8A-8D can be stored in a memory area of the ROM 52.

The urgency in a message prompting the user to replace the web sheet 2A is greater for the opening 8D than for the opening 8C, greater for the opening 8C than for the opening 8B, and greater for the opening 8B than for the opening 8A. Alternatively, the CPU 51 might display the number of sheets on which images can be formed by the time the web sheet 2A is replaced. This number of sheets is smaller for the opening 8D than for the opening 8C, smaller for the opening 8C than for the opening 8B, and smaller for the opening 8B than for the opening 8A.

With reference to FIG. 6B, the web sheet 2B has openings 81A-81E formed as detection parts in a zone extending in the wind-up direction S and having the width W1. The dimensions of the openings 81A-81E in the wind-up direction S are equal. A memory area of the RAM 53 may be allotted for a counter, which the CPU 51 causes to count the number of times detection signals are input from the detector 20 to the CPU. According to the count from the counter, the CPU 51 displays the different degrees of urgency in the messages prompting the user to replace the web sheet 2B. Alternatively, according to the count, the CPU 51 might display different numbers of sheets on which images can be formed by the time the web sheet 2B is replaced.

The openings 81A-81E in the web sheet 2B are spaced at intervals shorter toward the trailing end of the sheet. This makes it possible to gradually shorten the intervals at which the display on the display 56 changes.

As shown in FIG. 6A and stated already, the web sheet 2A has four openings 8A-8D arrayed in the wind-up direction S. When one of the last three openings 8B-8D is detected by the detector 20, one of the first three openings 8A-8C may reach the cleaning position P. If any of the openings 8A-8C stopped in the cleaning position P, the cylindrical surface of the heating roller 37A would be cleaned insufficiently.

The detection of each of the first three openings 8A-8C by the detector 20 enables the CPU 51 to recognize the position of the opening in the sheet path, that is, the distance between the current position of the opening and the cleaning position P. Because the turns of the web sheet 2A on the wind-up roller 4 are equal in length, the CPU 51 can calculate from the number of turns of the sheet on this roller the distance each of the openings 8A-8C has moved. With reference to FIG. 4, if each of the openings 8A-8C moves a distance ranging between LW1 minus LW2 (LW1−LW2) and LW1 minus LW2 plus N (LW1−LW2+N) after detected by the detector 20 while the wind-up roller 4 is winding up the web sheet 2A, this roller is kept rotating until it further winds up the sheet by a length equal to or longer than N. This prevents the openings 8A-8C from stopping in the cleaning position P.

The distance LS2 between the trailing end of the web sheet 2A and the first opening 8A is shorter than the sum of the circumferential length LR of the delivery roller 3 and the distance LW1. The distance LW1 is the length of the portion of the sheet path that extends between the cleaning position P and the position where the web sheet 2A leaves the cylindrical surface of the delivery roller 3. The first opening 8A does not reach the cleaning position P before the detector 20 detects the last opening 8D between the cleaning position and the position where the web sheet 2A leaves the cylindrical surface of the delivery roller 3.

As stated already, the web sheet 2 wound on the delivery roller 3 is impregnated with silicon oil or another cleaning agent, which may affect the detection of the opening 8 by the detector 20. Therefore, a web sheet 2 impregnated with no cleaning agent might alternatively be wound on the delivery roller 3 and supplied with a cleaning agent between the detector 20 and the cleaning position P. For example, the tension roller 6 might supply the cleaning agent, so that the apparatus could avoid being large in size. This applies to the web sheets 2A and 2B as well.

The detector 20 would not be limited to what detects the electric connection between the terminals 21 and 22. The detector 20 might be replaced by a contact type sensor on condition that it would not damage the surfaces of the web sheet 2. Alternatively, the detector 20 might be replaced by a non-contact sensor such as an optical sensor.

The detection part is not limited to the opening 8. If the detector 20 were an optical sensor, a sheet different in light reflectance or transmittance from the material for the web sheet 2 might be stuck as a detection part on the web sheet. This applies to the web sheets 2A and 2B as well.

Another cleaning device identical with the cleaning device 1 may be provided for the pressing roller 37B. A cleaning device according to the present invention can be used with not only the fixing device of an image forming apparatus but also another device having a part that should be cleaned with a cleaning belt.

It should be considered that the foregoing descriptions of the embodiments are illustrative in all respects and not restrictive. The scope of the present invention is defined by the appended claims, not by the embodiments, and intended to include meanings equivalent to those of the elements of the claims and all modifications in the claims.

What is claimed is:

1. A cleaning device comprising:

a cleaning belt;

an unwinder wound with the cleaning belt;

a winder for winding up the cleaning belt intermittently from the unwinder along a path leading past a cleaning position where the belt is brought into contact with a body to be cleaned; and a detector fitted in a detecting position on the path between the unwinder and the cleaning position, wherein the cleaning belt has an end point set thereon near the trailing end of the belt, the end point associated with the detecting position, the detector is adapted to output a detection signal when detecting the end point, the cleaning belt has an opening as a detection part to be detected by the detector, the detection part positioned at the end point and at a preset distance from the trailing end of the cleaning belt and in a zone spaced from at least one edge of the belt, the detector has a pair of terminals for compressive contact with both sides of the cleaning belt in a range covering the zone, and the detector is adapted to detect the opening based on electric connection between the terminals, and the cleaning device further comprises a cleaning agent supplier for supplying a cleaning agent to the cleaning belt in the path between the detector and the cleaning position.

2. The cleaning device according to claim 1, wherein the winder winds up the cleaning belt in such a way that the detection part does not stop in the cleaning position.

3. The cleaning device according to claim 1, wherein the unwinder includes a delivery roller wound with the cleaning belt on the cylindrical surface thereof, the preset distance being longer than the sum of the circumferential length of the delivery roller and the distance between the detector and the position where the cleaning belt leaves the cylindrical surface of the roller.

4. The cleaning device according to claim 1, wherein the unwinder includes a delivery roller wound with the cleaning belt on the cylindrical surface thereof, the preset distance being shorter than the sum of the circumferential length of the delivery roller and the distance between the cleaning position and the position where the cleaning belt leaves the cylindrical surface of the roller.

5. The cleaning device according to claim 1, wherein the cleaning belt has a plurality of detection parts to be detected by the detector, the detection parts positioned at the end point and in a zone spaced from at least one edge of the belt, the detection parts also positioned at preset distances from the trailing end of the belt, the detection parts spaced from each other longitudinally of the belt.

6. A fixing device for fixing on a recording medium a toner image transferred to the medium, by heating and pressing the medium, the device comprising:

a pair of rollers between which the recording medium passes and the cleaning device according to claim 1 and fitted at part of the cylindrical surface of at least one of the rollers as the cleaning position.

7. An image forming apparatus for forming on a recording medium an image made of toner by means of electrophotographic image formation, the apparatus comprising:

the fixing device according to claim 6 and a controller for prompting a user to replace the cleaning belt based on the detection signal output from the detector.

8. The image forming apparatus according to claim 7, wherein the controller has a memory for storing the relation between the detection signal and the number of times the apparatus can perform image formation until the cleaning belt is replaced, and wherein the controller informs the user of the number of times in order to prompt the user to replace the belt.

* * * * *